US005429178A

United States Patent [19]

Garey et al.

[11] Patent Number: 5,429,178

[45] Date of Patent: Jul. 4, 1995

[54] DUAL TUBE FOULING MONITOR AND METHOD

[75] Inventors: John F. Garey, Marion; David J. Schlottenmier, Buzzards Bay, both of Mass.; Murray F. Feller, Micanopy, Fla.

[73] Assignee: Electric Power Research Institute, Inc., Palo Alto, Calif.

[21] Appl. No.: 165,750

[22] Filed: Dec. 10, 1993

[51] Int. Cl.[6] ..... F28G 13/00

[52] U.S. Cl. ..... 165/11.1; 165/95; 73/861.79; 374/142

[58] Field of Search ..... 165/11.1, 95; 73/861.75, 61.62; 374/43, 44, 135, 142, 148

[56] References Cited

U.S. PATENT DOCUMENTS

| | | | |
|---|---|---|---|
| 3,477,289 | 11/1969 | Wiebe | 374/142 |
| 4,265,127 | 5/1981 | Onoda | 73/861.79 X |
| 4,385,658 | 5/1983 | Leonard | 165/11.1 |
| 4,390,058 | 6/1983 | Otake et al. | 165/95 X |
| 4,476,917 | 10/1984 | Otake et al. | 165/95 X |
| 4,644,787 | 2/1987 | Boucher et al. | 374/142 X |
| 4,762,168 | 8/1988 | Kawabe et al. | 165/11.1 |
| 4,766,553 | 8/1988 | Kaya et al. | 165/11.1 X |
| 5,083,438 | 1/1992 | McMullin | 165/11.1 X |
| 5,215,704 | 6/1993 | Hirota | 376/245 |
| 5,255,977 | 10/1993 | Eimer et al. | 165/11.1 X |

*Primary Examiner*—Martin P. Schwadron

*Assistant Examiner*—L. R. Leo

*Attorney, Agent, or Firm*—Thomas A. Kahrl

[57] ABSTRACT

An electro-mechanical, dual tube and plug device for on-line monitoring of performance losses due to reduced conductivity of a heat exchanger resulting from micro-bio fouling of the surfaces of said heat exchanger/condenser and for detecting change of heat transfer resistance of individual heat transfer tubes. The dual tube and plug assembly includes a first flow assembly tube and a second temperature assembly tube attached to the discharge end of a heat exchanger for providing accurate measurement of temperature and cooling water flow. The first flow assembly tube includes a tube having an inner chamber, including a flow sensor comprising a paddle wheel and a sensor and a temperature sensor for measuring discharge water temperature. The second temperature assembly tube plugs the inlet and the outlet of a heat transfer tube immediately adjacent to the flow assembly tube and includes a plurality of spring loaded temperature sensors in the plugged empty heat transfer tube. Flow and discharge temperature signals from a first dual tube device are combined with other flow and discharge temperature signals, from additional dual tube devices. These signals are sent to a micro-processor which, utilizing inlet water temperature data provided by an inlet temperature sensor, continuously calculates, records and displays the individual heat transfer tube heat transfer co-efficient.

13 Claims, 4 Drawing Sheets

DUAL TUBE FOULING MONITOR AND METHOD

BACKGROUND OF THE INVENTION

This invention relates to on-line monitoring of performance losses due to reduced conductivity of a heat exchanger resulting from fouling of the surfaces of the heat exchanger. Monitoring the effect of scaling and micro-bio fouling, both contributing to fouling occurring within operating heat exchangers and condensers is often difficult since conventional measured operating parameters can not easily isolate fouling effects from other monitored performance losses. Typically prior art monitors of performance losses of heat exchangers have used indirect measurements, such as inlet header temperature compared with discharge header temperature, vacuum in the condenser section and aggregate flow measurements for calculating an estimated fouling factor for an operating heat exchanger, wherein the calculated performance results were actually estimates as they lacked accuracy.

It is for this reason, prior efforts have recently been directed toward development of side-stream monitoring units which attempt to simulate operating conditions of an operating exchanger. If working parameters such as heat flux, fluid flow and tube metallurgy can be duplicated, it is assumed that fouling will, likewise, be similar. Applicant is aware of one such prior art device covered by U.S. Pat. No. 4,762,168 to Kawabe et al. which includes a by-pass line having a monitor tube of the same material and size as the condenser tubes. Although such prior art side-stream units appear promising, especially for the simultaneous testing of various fouling control options, they cannot replicate all conditions of a full-scale condenser or exchanger, for example tube length, temperature rise, tube aged condition, changing load and flow parameters, etc. For this reason, side-stream monitoring systems are often viewed with skepticism by plant performance engineers when they are used as monitors for condensers or heat exchangers.

Applicant is aware of additional prior art attempts at on-line monitoring which have been met with varying degrees of success, in particular a device disclosed by ESEERCO in 1987.

ESEERCO investigated using an instrumented probe which is inserted trough the discharge water box of a condenser and traverses the free jet of cooling fluid characteristically emanating from individual heat transfer tubes. The probe instrumentation includes fluid temperature and flow (pitot) sensors, which provides discharge fluid temperature and flow velocity data for each traversed tube. This information is combined with the inlet water temperature, and the saturated steam temperature calculated from steam back pressure data. These data are then used to calculate heat transfer resistances for individual heat transfer tubes. The major disadvantages of the ESEERCO approach are:

1. Perfect alignment of the probe with each measured heat transfer tube is critical since a slight offset will significantly influence flow measurements of the probe.
2. Steam temperature for the heat transfer tube being monitored is not measured , but is assumed to be the same as the average condenser temperature— this assumption may not be correct.
3. The approach does not lend itself easily to continuous on-line monitoring.

Czolkoss (Taprogge Inc.) as disclosed in 1990 uses another approach to on-line monitoring connected directly to an operating heat exchanger . The Czolkoss method uses miniature thermocouples mounted on the inlet and outlet of each heat transfer tube to be monitored,as is shown in FIG. 9, a hydraulic closure device is mounted on the discharge tube sheet and serves to close a selected tube for some time. Over a ten minute period, the coolant water in the tube assumes the temperature of steam being condensed in the condenser and therefore determines the steam temperature. The tube is then reopened. In the Czolkoss method the outlet thermocouple first measures the saturated steam temperature, then after a certain period of time ($T_0$), measures the discharge water temperature. The amount of time required to go from the steam temperature to the discharge temperature is directly correlated to the flow velocity of coolant water. With this data, the on-line heat transfer coefficient is then calculated.

This method overcomes many of the disadvantages of the transverse probe of ESEERCO, but has several major drawbacks of its own, including:

1. During the measuring process, the water temperature is raised to the steam saturation temperature, which is often high enough to destroy biofilm attached to the heat transfer tubes with the result that harmful scaling could result.
2. The rapid hydraulic closing and reopening of selected tubes creates a flow excursion which has been shown to result in significant sloughing of attached fouling deposits.

The problem not recognized by the prior art is that performance sensors fail to provide accuracy in directly measuring temperature and flow parameters in a heat exchanger while operating, because they interfere with the operation of the system as installed, with the result that the parameters to be tested are altered. Heretofore such interference has been compensated for by values not directly measured, but computed, or given an assumed value.

The ideal condition for monitoring fouling within condenser or exchanger systems requires a method to accurately measure change in heat transfer of the system as measured by change in heat transfer of actual heat transfer tubes within the heat exchanger while the heat exchanger is operational, or, in other words, an on-line fouling monitor.

The present invention has solved this problem in a novel fashion by providing internal temperature and internal flow sensors positioned in individual heat transfer tubes connected by circuitry with a monitor. This system provides for continuous on-line measurement of temperature and flow values in an operational heat exchanger with continuous measurement, calculation and display of performance characteristics, without altering the operating characteristics or environment of the system being monitored. In so doing, it is found desirable to provide a new and improved on-line monitoring device and method whereby said the on-line monitoring device provides accurate measurement of the combination of measurement of reduced conductivity of a heat exchanger resulting from scaling or microbio fouling and a cooling water flow sensor wherein the on line monitor continually monitors the signals of the temperature and flow sensor to provide a continuous reading of the heat transfer co-efficient determining any deterioration in the performance of the heat exchanger and to overcome at least some of the disadvantages of the prior art heat exchanger performance devices and methods.

SUMMARY OF THE INVENTION

This invention relates to a temperature and flow sensing device for continuously monitoring heat transfer efficiency of individual heat transfer tubes of an operating heat exchanger, to an on-line fouling monitoring system for providing continuous on-line measurement of temperature and flow values in an operational heat exchanger with continuous measurement, calculation and display of performance characteristics, all without altering the operating characteristics or environment of the system being monitored and to a method incorporating the fouling monitoring system which provides accurate measurement of the combination of reduced conductivity of the heat exchanger resulting from scaling or micro-bio fouling to provide a continuous reading of the heat transfer coefficient determining any deterioration in the performance of the heat exchanger. In this system, the monitor displays computed thermo-efficiency values which display the extent of reduced conductivity of a tube of the heat exchanger resulting from fouling of the surface of said tubes and associated change of heat transfer resistance of individual thereof. With these values accurately computed, it permits a plant manager to calculate optimal timing of periodic cleaning of the heat exchanger for greater sustained efficiency and minimal environmental impact due to limiting the amount of cleaning chemicals released.

In particular, the invention is directed to a novel dual tube combination flow and temperature sensing device adapted to measure temperature and flow changes inside individual condenser tubes of the heat exchanger due to fouling of said tubes. Such changes typically are the result of carbonate type scaling or are due to fouling of the surfaces of said tubes of said heat exchanger as a result of micro-bio fouling.

The invention further relates to a novel monitoring system for directly sensing performance losses of the heat exchanger resulting from fouling by sensing and displaying changes in cooling flow path characteristics in a heat exchanger. This is accomplished by combining discharge flow with inlet and discharge temperature signals from a plurality of the dual tube and plug devices, including a first dual tube and plug assembly spaced apart from a second dual tube and plug device; by combining the signals in a multiplex data microprocessor for transmission to and display by a monitor. This system is adapted for use with a heat exchanger having an inlet end and a longitudinally spaced outlet end, of conventional construction, including a plurality of heat transfer tubes extending longitudinally between the inlet end and the outlet end. This novel system provides continuous monitoring of internal heat transfer conditions in the heat exchanger by measuring the difference between a first set of conditions, i.e. a clean condition temperature and a second set of operating temperature conditions, and by measuring the difference between a first set of velocity signals of cooling fluid flow and a second set of velocity signals indicating reduced flow, and combining the two sets of differential signals in an on-line monitor. The on-line monitor, typically a conventional PC based Data Acquisition system, compares the first set of conditions with the second set of conditions for directly computing and displaying, on a conventional display screen device, performance losses of a heat exchanger resulting from fouling of said heat exchanger.

In the preferred embodiment the dual tube and plug device includes both flow and temperature sensors, including at least two temperature probes mounted in a heat transfer tube which is plugged at the inlet end and outlet end to provide a dry temperature sensing tube. By providing a dry tube, said dual tube and plug device provides greater accuracy of the temperature signals for a given heat transfer tube or for the condenser as a whole. The temperature sensors are connected by circuitry with an internal flow indicator mounted in a flow monitoring tube for detecting coolant fluid flow conditions in selected individual heat transfer tubes, thereby giving greater accuracy of flow conditions in selected tube elements. By measuring the differential flow temperature of the coolant fluid, i.e. by relating the temperature differential of the heat exchanger as a function of flow, with allowance for decay in the velocity and amount of flow, the change of heat transfer resistance of heat transfer tubes can be more accurately detected. Effective monitoring of fouling of a heat exchanger requires accurate measurement of individual heat transfer tubes with respect to quantity and velocity of the cooling water flow, as well as temperature differential at the inlet and discharge end of the heat exchanger. This permits the computation of thermal efficiency of the heat exchanger tube as a whole and that this thermal efficiency be continuously monitored and continuously displayed.

The algorithm programmed into the microprocessor will compute heat transfer resistance for each flow tube and plug tube set. The preferred method is based on the rearrangement of a common equation derived in many basic heat transfer texts, used for heat exchanger design as detailed below;

V = Coolant Flow Rate (M/sec) Each Tube
$Q_H$ = Heat Flux (watts)
$T_I$ = Coolant Inlet Temperature (°C.)
$T_E$ = Coolant Outlet Temperature (°C.)
$T_S$ = Steam Temperature (°C.)
U = Heat Transfer Coefficient (watts/$M^2$-°C.)
$R_T$ = Heat Transfer Resistance ($M^2$-°C./watts)
LMTD = Logarithmic Mean Temperature Difference
$A_H$ = Area, Heat Exchanger (Effective) ($M^2$)
$A_C$ = Area, Tube Cross Section ($M^2$)
$C_P$ = Specific Heat of Water (watts/°C.-Kg)
P = Density of Water (Kg/$M^3$)
M = Mass Flow of Coolant Water (Kg/sec)

$$Q_H = MC_P(T_E - T_I)$$
$$M = PVA_C$$
$$\therefore Q_H = PVA_CC_P(T_E - T_I)$$

also $$Q_H = UA_H(LMTD) = UA_H\left[\frac{(T_E - T_I)}{\ln\frac{(T_S - T_I)}{(T_S - T_E)}}\right]$$

$$\therefore PVA_CC_P(T_E - T_I) = UA_H\left[\frac{(T_E - T_I)}{\ln\frac{(T_S - T_I)}{(T_S - T_E)}}\right]$$

reorganizing yields: solving for $1/U = R_T$ by definition $$R_T = \frac{1}{U} = \frac{A_H\left[\dfrac{(T_E - T_I)}{\ln\dfrac{(T_S - T_I)}{(T_S - T_E)}}\right]}{PVA_C C_P(T_E - T_I)}$$

or $$R_T = (\text{CONSTANT})\left[\frac{\dfrac{(T_E - T_I)}{\ln\dfrac{T_S - T_I)}{(T_S - T_E)}}}{V(T_E - T_I)}\right]$$

This calculation assumes that the heat exchanger is operating under steady state conditions and the tube area/heat exchanger area are constant. Further improvements in accuracy of calculation are possible by mathematically dividing the tube into differential elements and utilizing the algorithms as outlined above.

Initial conditions are measured with clean heat transfer tubes to establish a reference $R_T$. With use, $R_T$ will increase and when it reaches a predetermined value, due to the buildup of scale etc., it indicates a need for maintenance services, such as cleaning the internal surfaces of the heat transfer tubes.

In the preferred embodiment, the dual tube and plug assembly consists of a first flow tube assembly connected to a second temperature assembly tube wherein said first tube assembly contains a flow sensor and the second tube contains a temperature sensor apparatus. In this embodiment, the first tube assembly includes an inner chamber having a flow sensor, typically consisting of a rotatable paddle wheel, and associated temperature sensor for measuring discharge water temperature. A critical feature of the first flow tube construction is that the ID of the wall of said tube is identical to the ID of the heat transfer tube being monitored.

The second temperature assembly tube contains a temperature sensor apparatus and includes an inlet plug assembly with an integral temperature inlet sensor, FIG. 5, and an outlet plug, wherein said plugs are adapted for sealing the inlet and outlet ends of the temperature monitor tube. The location of the temperature monitoring tube is selected to be in a position immediately adjacent to the first tube containing the flow sensor assembly and includes a plurality of spring loaded temperature sensors positioned in the plugged empty temperature monitor tube. Each spring loaded surface temperature sensor, typically a platinum RTD, is inserted into this blocked-off temperature monitoring tube to measure saturated steam temperature.

In the preferred embodiment, a critical feature of the dual tube and plug assembly is that it is mounted on the discharge end of the tube sheet of the heat exchanger in a manner to occupy a minimal amount of space on the tube sheet and configured to have a minimal impact on the operating condition of the heat exchanger. This dual tube and plug assembly as is shown in FIG. 7 is mounted on the outlet or discharge end of the tube sheet at the base of the second tube assembly for sensing temperatures at the discharge end of the selected heat transfer tube, designated as the temperature monitoring tube, with the first tube assembly mounted coaxially on the discharge end of the flow monitoring tube. The flow and discharge temperature signals from a first dual-tube device, are combined with other flow and discharge temperature signals, from additional remotely spaced dual tube and plug devices. These signals are sent to a micro-processor of conventional construction which, utilizing inlet water temperature data provided by the inlet temperature sensors, continuously calculates, records and displays the individual tube heat transfer co-efficient. In this embodiment, any number of dual tube and plug assemblies are monitored within a heat exchanger shell, whereby electronic signals from each assembly are multiplexed to the external micro-processor. This data is combined with temperature data from a matched inlet water temperature RTD positioned in the inlet end of the operating heat exchanger and is used to continuously calculate the heat transfer coefficient.

As is shown in FIGS. 2, 3, & 7, the first tube assembly contains a proximity sensor positioned adjacent to the flow sensor. The proximity sensor is utilized to monitor wheel rotations without having to use sensing devices such as magnets which are often fouled by iron deposits. Within the same chamber as the flow sensor is a platinum RTD which measures the discharge water temperature. A spring loaded RTD sensor which monitors the saturated steam temperature is inserted into the closed system temperature monitor tube. This temperature sensor may be located at any point along the length of the blocked off temperature monitoring tube wherein the true isothermal steam temperature is provided. The temperature signal is returned from the blocked off heat transfer tube through a water tight fitting to a discharge waterbox assembly, where it is combined with the other flow and discharge temperature signals. These signals pass out of the heat exchanger discharge waterbox to a microprocessor which, utilizing inlet water temperature data, continuously calculates, records and displays the heat transfer tube's heat transfer coefficient. In the preferred embodiment, four assemblies mounted within a condenser shell are envisioned. Electronic signals from each will be multiplexed to this external microprocessor.

As provided in an alternate embodiment, the dual tube assembly comprises a probe assembly comprises a first flow assembly tube and a second temperature assembly tube, wherein the flow assembly tube comprises a cylindrical tube characterized by an inner chamber having a flow paddle wheel and a proximity sensor both positioned within said cylindrical tube. In this embodiment, the exterior wall of said tube is constructed to be inserted within the interior diameter of a heat transfer tube at the discharge end. The proximity sensor is utilized to monitor wheel rotations without use of magnets, as commonly used in the prior art. Positioned within the same inner chamber as the flow sensor is a platinum (RTD) which measures the discharge water temperature.

The second temperature tube assembly is used to plug the heat transfer tube immediately adjacent to the flow assembly tube. The second temperature tube assembly includes an inlet sensor plugged on the inlet end of the heat transfer tube and includes a spring loaded sensor, typically a matched RTD sensor, to monitor the saturated steam temperature. Typically this sensor may be located at any point along the length of the blocked off heat transfer tube where the condenser condition indicates that true iso-thermal steam temperature is provided throughout the length of the second temperature tube assembly cylindrical tube. Flow and temperature signals from the flow paddle wheel and the sensor are returned through a water tight fitting to the discharge heat transfer tube assembly where they are processed with other flow and discharge temperature signals. In a micro-processor which , utilizing the inlet water temperature data, continuously calculates and records and displays the heat transfer tube heat transfer co-efficient.

The dual tube and plug device is configured for monitoring performance losses in a variety of heat exchangers. For example, monitoring a condenser in a thermoelectric or steam generator, land based steam power plant, chemical plant or marine power plant.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

DETAILED DESCRIPTION OF THE PREFERRED EMBODIMENT

Figure 1:
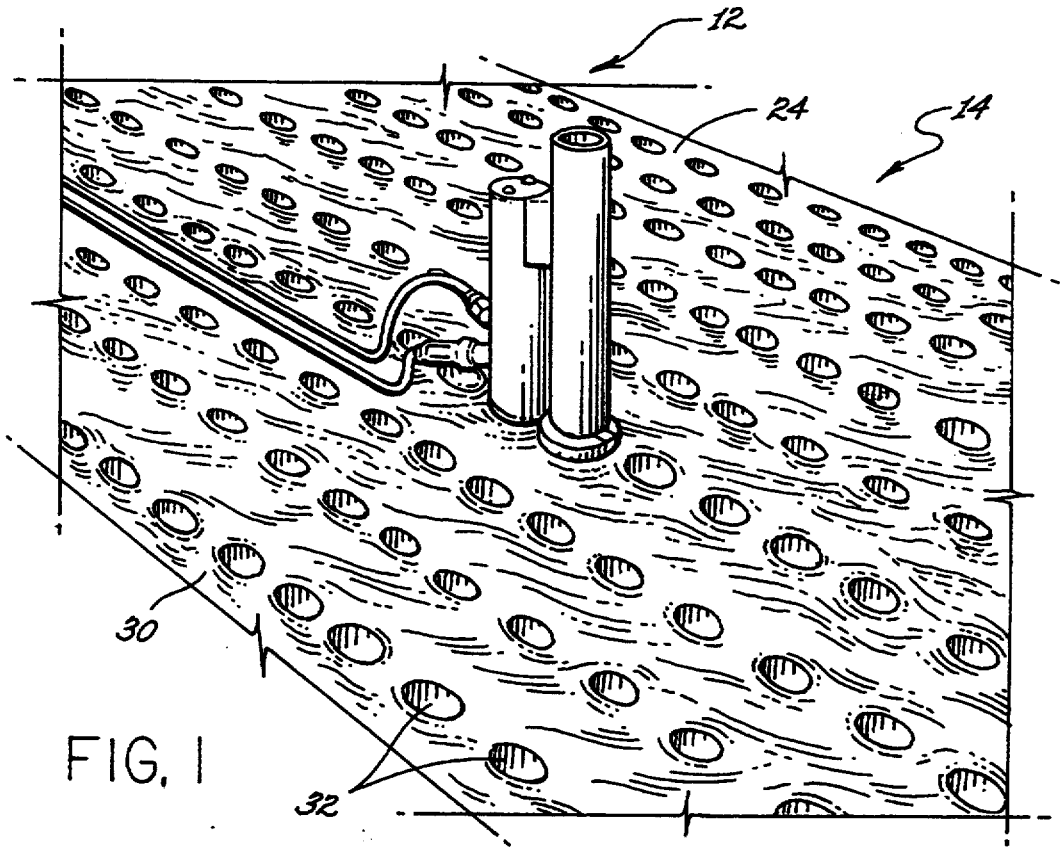
FIG. 1 is a perspective view from above showing a condenser equipped with a dual tube fouling monitor according to the present invention.
Figure 2:
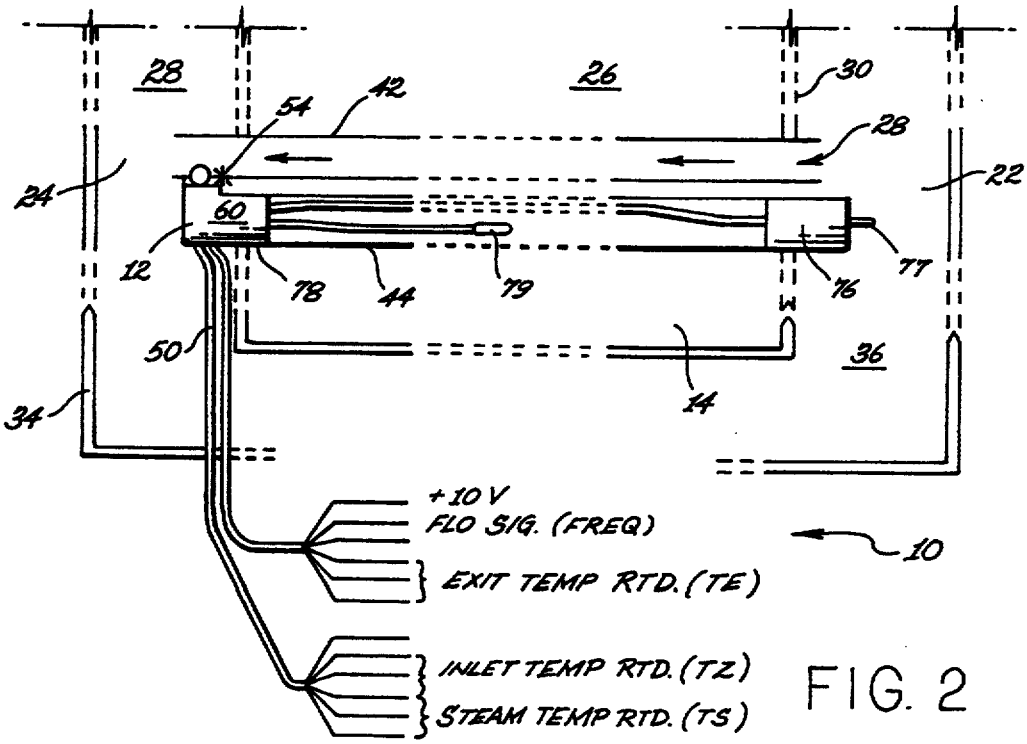
FIG. 2 is a schematic view showing a heat exchanger equipped with a dual tube fouling monitor according to the present invention of FIG. 1.

There is shown as is set forth in FIG. 1–9 a fouling monitoring system 10 including a dual tube and plug sensing device 12 mounted on a heat exchanger 14 and connected to a monitoring apparatus 16 including a microcomputer 18 and a display monitor 20. The heat exchanger 14 as is shown in FIG. 2 includes an inlet header 22 at the inlet end spaced from an discharge header 24 at the outlet end and includes a steam zone 26 and a coolant fluid zone 28. In the preferred embodiment coolant fluid 36 typically is sea water.

Figure 3:
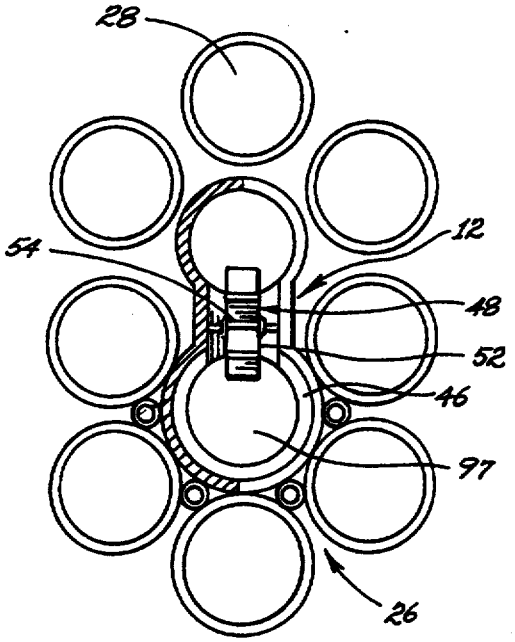
FIG. 3 is an end view arrangement of the dual tube fouling monitor of the invention of FIG. 1 attached to a tube sheet.

In the preferred embodiment, the heat exchanger 14 includes a tube sheet 30 shown in FIG. 1 forming a heat exchange surface between the coolant fluid 36 and the steam entering the heat exchanger 14 consisting of a plurality of individual heat transfer tubes 32 extending longitudinally between the inlet header 22, for separately introducing exhaust steam and the coolant fluid 36 into the heat exchanger 14 and the discharge header 24 at the outlet end 34. The dual tube and plug sensing apparatus 12 is mounted at the discharge end of a flow monitoring tube 42 and an adjacent temperature monitoring tube 44 as is shown in FIG. 2 & 3. The dual tube and plug sensing apparatus 12 consists of a flow assembly tube 46 positioned in coaxial relationship with the flow monitoring tube 42 at the discharge end and includes a flow sensor 48 electrically operated and attached to conduit means 50 mounted in an inner chamber 52 extending perpendicularly with said flow assembly tube 46 and including a rotable paddle wheel 54. Said paddle wheel 54 is positioned in association with a wheel sensor 56 connected electrically by conduit 50 to the fouling monitoring system 10, wherein said paddle wheel 50 extends into the tubular conduit 58 of the flow assembly tube 46 adapted for guiding coolant fluid 36 to be measured for directly measuring the coolant flow through said tubular conduit. Said dual tube and plug sensing device 12 includes a plug device 60 adapted for attachment to the discharge end of the temperature monitoring tube 44.

The display monitor 20 is connected to the microprocessor and then, by conduit 50, to one or more of the dual tube and plug sensing devices 12 and is for displaying the system operating conditions. The micro-processor 80 is continuously calculating, recording, and displaying the individual heat exchanger tube heat transfer coefficient and flow index on a display panel 82. A mounting collar 84 is provided for supporting the dual tube and plug sensing apparatus 12 at the discharge end of tube sheet 30.

As is shown in FIG. 2, there is positioned, a discharge temperature sensor 81, in the same chamber as the flow sensor 48, typically a platinum RTD is positioned for measuring discharge water temperature. An inlet plug 76 an a discharge plug 78 are provided to plug the temperature monitoring tube adjacent to the flow sensor tube. Also a spring loaded RTD sensor 79 positioned in the steam sensor tube to monitor saturated steam temperature is positioned in the closed temperature monitoring tube 44. The steam temperature signal transmitted by the sensor 79 is returned through a water tight fitting 90 through the dual tube and plug sensing apparatus 12 where it is processed with other flow and discharge temperature signals by the microprocessor 18. Signals from the dual tube and plug sensing apparatus 12 pass out of the discharge waterbox 92 to the microprocessor 80 via a first branch adaptor 94 and a second branch adaptor 96 for use in providing a conduit for the electrical connectors 50 by providing e water tight branch aperture 93.

Figure 4:
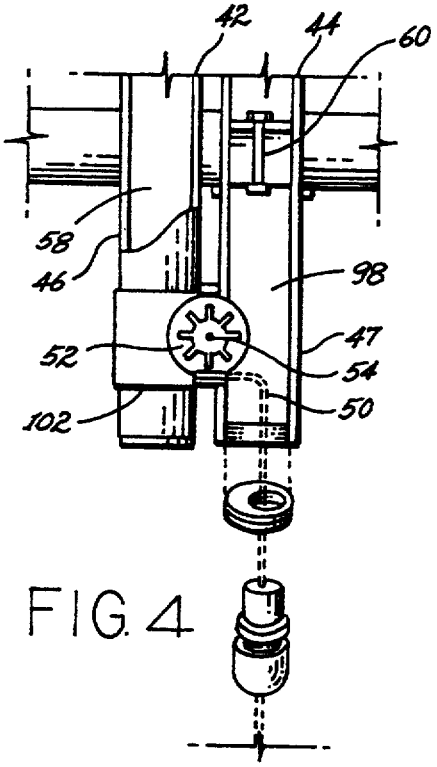
FIG. 4 is a schematic view side showing the dual tube fouling monitor partially cut away to show the paddle wheel of the flow sensor of the present invention of FIG. 1.
Figure 5:
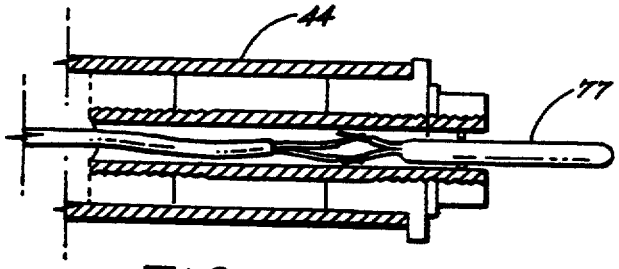
FIG. 5 is a schematic side view showing the dual tube fouling monitor partially cut away to show the inlet temperature probe of the present invention of FIG. 1.
Figure 6:
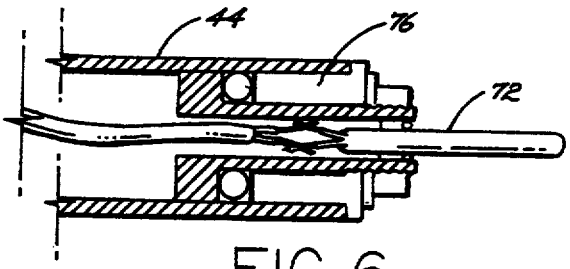
FIG. 6 is a schematic view side view showing the dual tube fouling monitor, partially cut away to show an alternate embodiment of the inlet temperature probe of the present invention.
Figure 7:
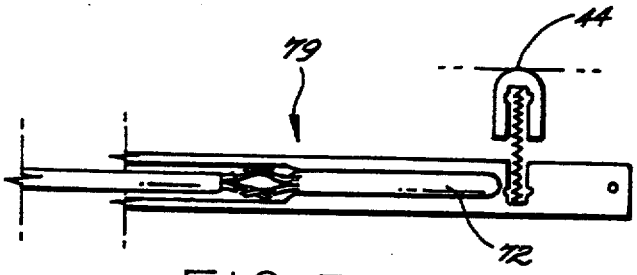
FIG. 7 is a schematic view side view showing the dual tube fouling monitor, partially cut away to show a spring loaded RTD sensor of the present invention of FIG. 1.
Figure 8:
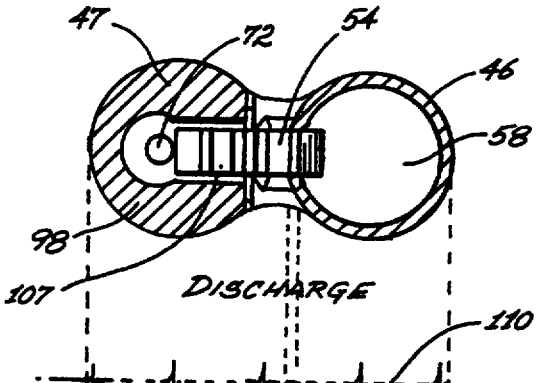
FIG. 8 is an end view arrangement of the dual tube fouling monitor in section taken along lines 7—7 of FIG. 8 of the invention of FIG. 1 attached to a heat transfer tube sheet.
Figure 9:
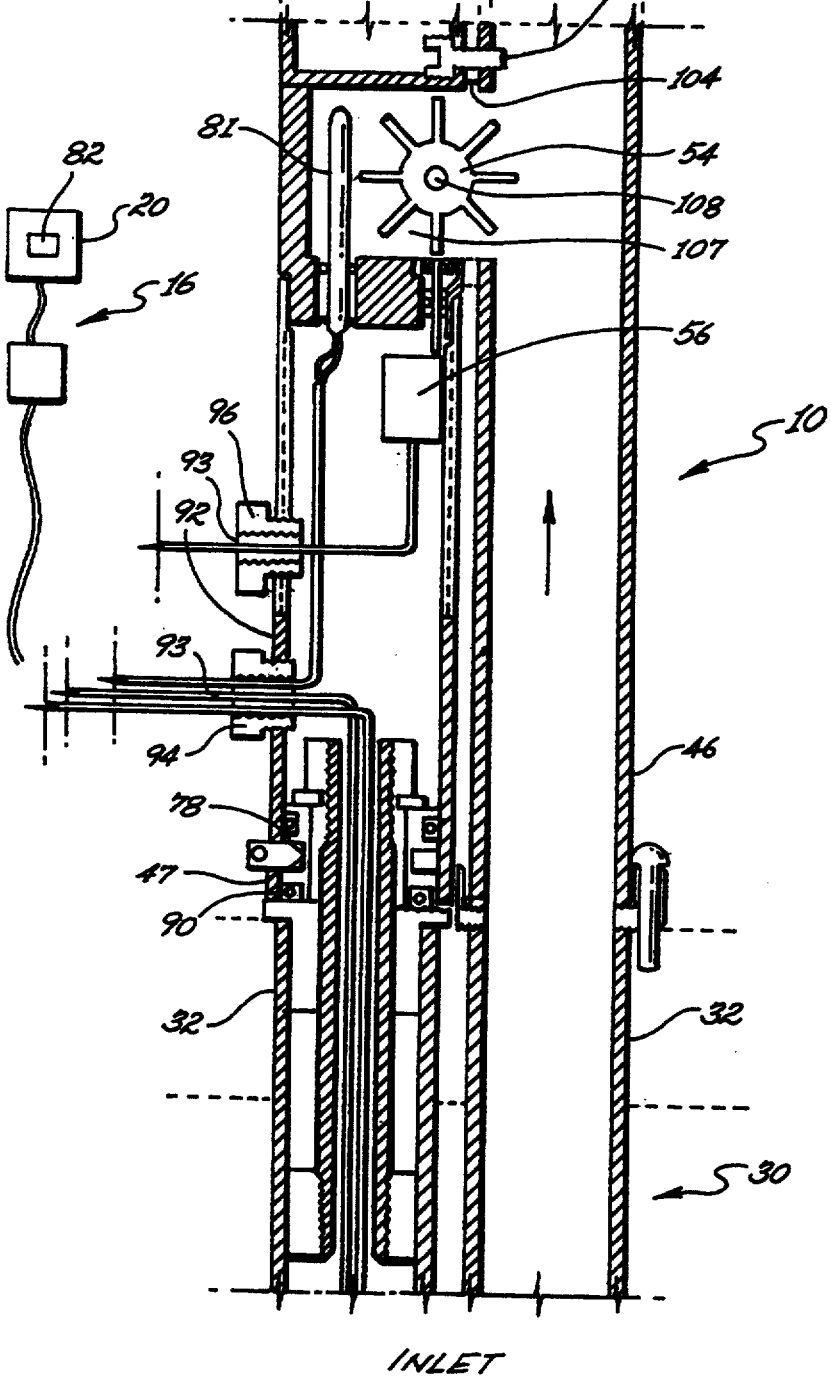
FIG. 9 is a sectional side view showing a dual tube fouling monitor system installed on a heat exchanger incorporating the dual tube fouling monitor of the present invention of FIG. 1.
Figure 10A:
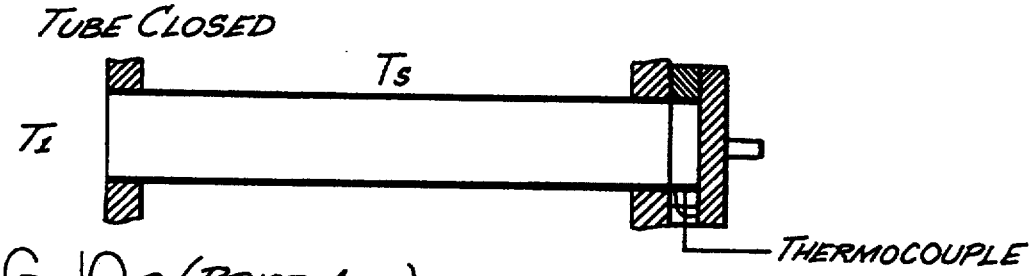
FIG. 10a (PRIOR ART)
FIG. 10 is a view of a prior art arrangement of the Taprogge "on-line monitor" showing the closed heat transfer tube and heat transfer tube opened method.
Figure 10B:
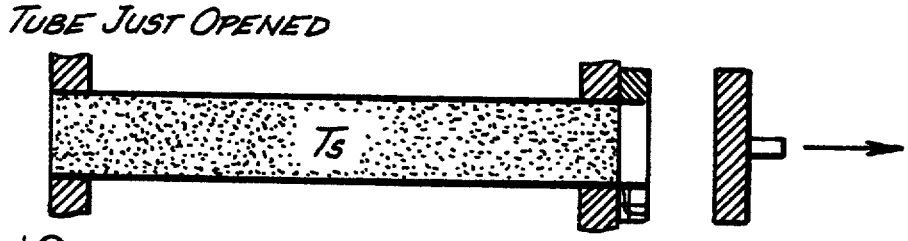
FIG. 10b (PRIOR ART)
Figure 10C:
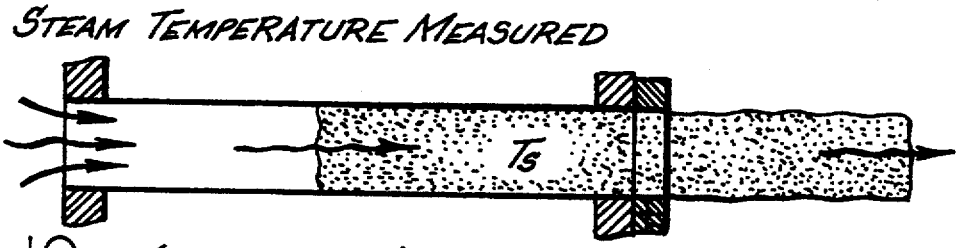
FIG. 10c (PRIOR ART)
Figure 10D:
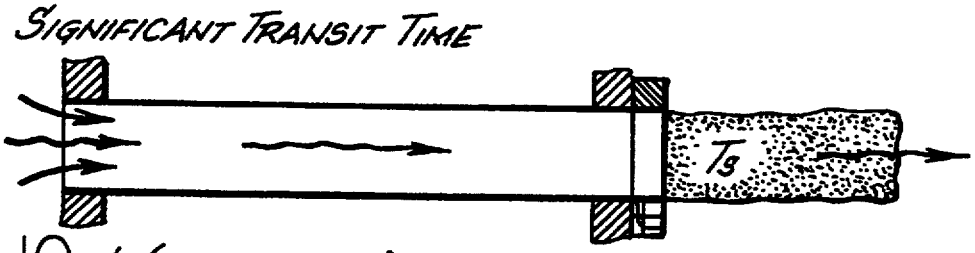
FIG. 10d (PRIOR ART)
Figure 10E:
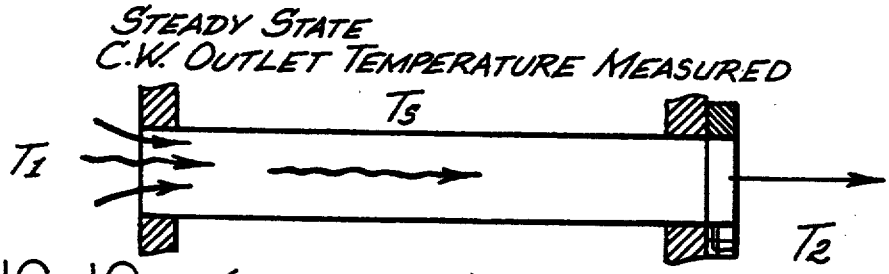
FIG. 10e (PRIOR ART)

As is shown in FIG. 4 the flow assembly tube 46 is characterized by a first open tubular conduit 58 for guiding coolant fluid 36 to be measured and the temperature assembly tube 47 is characterized by a second enclosed tubular conduit 98 for sensing saturated steam temperature with thermal sensors 72 disposed within said first and second enclosed tubular conduit connected by electrical conduit 50 connecting the thermal sensors 72, including inlet sensor 77 and 79 to a circuit for sending signals to a micro-processor 100. A branch adapter assembly 102 connects the first open tubular conduit 58 to the second enclosed tubular conduit 98 wherein each of said first and second tubular conduits have a convex external surface with a branch aperture 104, shown in FIG. 9 formed therein including an associated branch hole formed therein comprising an elongated member defining a body part 106 including a paddle wheel chamber 107 and an axle part 108 for supporting the paddle wheel 54 having a central aperture axially formed there through to permit communication with said paddle wheel, said paddle wheel chamber having the first connecting part in an opposite second connecting part and including sealing means 110 for sealing said body parts against said convex external surface of said first and second flow conduit.

What is claimed is:

1. A sensing apparatus adapted for use with a heat exchanger comprising:

a) heat exchanger means for condensing steam including a steam zone and a coolant fluid zone comprising;

i) tube sheet means for providing a heat exchange surface between said coolant fluid zone and said steam zone comprising a plurality of individual heat transfer tubes extending between an inlet header means, for separately introducing exhaust steam and coolant fluid into said heat exchanger means, and a discharge header means for separately extracting exhaust steam and coolant fluid from said heat exchanger means; said tube sheet means comprising;

ii) flow monitoring tube means including at least one heat transfer tube providing a fluid flow conduit; and iii) temperature monitoring tube means positioned immediately adjacent said flow monitoring tube means including at least one plugged heat transfer tube;

b) flow sensing means in combination with a temperature sensing means for individually sensing flow and temperature differentials in said flow monitoring tube means and temperature differentials in said temperature monitoring tube means consisting of a dual tube and plug apparatus connected to a discharge end of said flow monitoring tube means adjacent said discharge header means and a discharge end of said temperature monitoring tube means also adjacent said discharge header means, said dual tube and plug apparatus comprising:

i) a flow sensing device including a first flow assembly tube including a tubular conduit, anti a flow sensor mounted in an inner chamber for directly measuring said coolant flow through a heat transfer tube and a plug attachment for connection with said temperature monitoring tube means;

ii) a second temperature assembly tube configured to plug the outlet of the temperature monitoring tube means, for excluding coolant flow, immediately adjacent to the first flow assembly tube; and iii) temperature sensor means for detecting local absolute temperature of said temperature monitoring tube means;

c) plug means for sealing out coolant flow from a selected heat transfer tube comprising at least one plug device for attachment to the inlet end of said temperature monitoring tube means;

d) monitor means for comparing temperature differential signals and flow signals from said dual tube and plug assembly and for combining other flow and discharge temperature signals from one or more additional dual tube and plug apparatus connected to a microprocessor; and e) microprocessor means for utilizing flow and temperature differential data provided by the flow sensor and the temperature sensor means and for continuously calculated, recorded and displayed the individual tube heat transfer coefficient and flow velocity for the selected heat transfer tube.

2. The sensing apparatus of claim 1 wherein the first flow assembly tube comprises a tube having an inner chamber, including a flow sensor comprising a paddle wheel and a sensor.

3. The sensing apparatus of claim 1 wherein said flow assembly tube includes an exterior wall having an inner diameter identical to the inner diameter of said flow monitoring tube and said dual tube and plug apparatus includes frame means for supporting said dual tube and plug apparatus at said discharge header means.

4. The sensing apparatus of claim 1 wherein the temperature assembly tube provides a plug of inlet and outlet ends of said heat transfer tube immediately adjacent to said flow assembly tube and includes a plurality of spring loaded temperature sensors in a plugged empty heat transfer tube which being plugged and is empty of coolant fluid.

5. The sensing apparatus of claim 1 wherein said dual tube and plug assembly comprises;

a) a first flow assembly tube;

b) a second temperature assembly tube: and c) a temperature sensor for measuring discharge water temperature by means of a RTD sensor.

6. The sensing apparatus of claim 1 wherein a plurality dual tube and plug assemblies are utilized for monitoring within a condenser shell, whereby electronic signals from of said assemblies are multi-plexed to an external micro-processor for processing and display.

7. A fouling monitor system adapted for use with a heat exchanger comprising:

a) coolant means for cooling steam to form a condensate;

b) heat exchanger means for condensing exhaust steam comprising:

i) tube sheet means for supporting tubes which provide a heat exchange surface between said coolant means anti exhaust steam for condensing said exhaust steam comprising a plurality of heat transfer tubes;

ii) inlet header means for separately introducing exhaust steam and coolant into said tube sheet means; and iii) discharge header means for separately extracting condensate and exhaust coolant from said heat exchanger apparatus;

c) dual tube and plug means for sensing flow and temperature differentials comprising in a flow sensing means and temperature sensing means, in combination, comprising:

i) a first flow assembly tube having a flow sensor for accurately measuring cooling water flow comprising a plug device for attachment to a discharge end of said tube sheet means, and said first flow assembly tube characterized by an inner chamber including a paddle wheel connected to a wheel sensor for measuring discharge water temperature;

ii) a temperature assembly tube comprises a plurality of temperature sensors for detecting change of heat transfer resistance of a selected heat transfer tube comprising a pair of spaced apart probes; and iii) a pair of temperature sensors each comprising a plug device for an attachment to a discharge end of said tube sheet means, comprising a plurality of temperature sensors for detecting local temperature adjacent to a selected heat transfer tube comprising a pair of spaced apart probes:

d) monitor means for comparing temperature differential signals and flow signal from a selected first dual-tube device and for combining flow and discharge temperature signals from additional dual tube devices said monitor means comprising an on-line monitor connected to a microprocessor;

e) micro-processor means for utilizing inlet water temperature data provided by an inlet temperature sensor, continuously calculates, records and displays individual tube heat transfer co-efficient in the following manner:

$$Q = U_T A(T_{STEAM} - T_{WATER})$$
$$Q = MC_P(T_{WATEROUT} - T_{WATERIN})$$
$$\therefore R_T \propto \frac{(T_{STEAM} - T_{WATERLOCALTEMP})}{\text{VELOCITYWATER}(T_{WATEROUT} - T_{WATERIN})}$$

and f) outlet frame means for supporting a first dual tube and play assembly at an outlet of heat transfer tube end an inlet frame means for a second dual tube and plug assembly at an inlet of the tube sheet.

8. The fouling monitor system of claim 7 wherein said dual tube and plug means comprises a dual tube and plug assembly for an attachment to a discharge end of a tube sheet for providing accurate measurement of cooling water flow comprising:

a) temperature sensing means for detecting change of heat transfer resistance of a selected heat transfer tube by measuring discharge water temperature and comparing to inlet temperature; and b) flow sensing means for accurately measuring cooling water flow comprising a plug device for an attachment to a discharge end of a selected tube sheet.

9. A thermo-flow sensor for use with a heat exchanger comprising:

a) a first open tubular conduit for guiding fluid to be measured;

b) a second enclosed tubular conduit for sensing saturated steam temperature;

c) thermal resistance means for sensing temperature of said fluid having a longitudinal axis centrally disposed within said first and second tubular conduits;

d) electrical wire means connecting thermal resistance means to a circuit for sending signals to a micro-processor; and e) a branch adapter assembly connecting said first open tubular conduit to said second enclosed tubular conduit; wherein each of said first and second tubular conduits having a convex external surface with branch aperture formed therein including an associated branch hole formed therein comprising:

i) an elongated member defining a body part including an axle part for supporting a paddle wheel having a central aperture axially formed there through to permit communication with said paddle wheel, a paddle wheel chamber having a first connecting part opposite second connecting part and including sealing means for sealing said body parts against said convex external surface of said flow conduit and for sealing said fitting member against said convex external surface of said steam sensor.

10. A combination sensing apparatus adapted for on-line monitoring of performance losses of a heat exchanger with respect to temperature and flow due to fouling of surfaces of said heat exchanger/condenser comprising:

a) condenser/heat exchanger apparatus comprising in combination:

i) a tube sheet having a plurality of heat transfer tubes;

ii) an inlet header apparatus; and iii) a discharge header apparatus;

b) a plurality of dual tube and plug assemblies each having a plug device for attachment to a discharge end of said tube sheet, each having a flow assembly tube and a temperature assembly tube wherein said flow assembly tube comprises a flow sensor for accurately measuring cooling water flow, and a second flow assembly tube characterized by an inner chamber including a paddle wheel connected to a wheel sensor for measuring discharge water temperature;

c) the temperature assembly tube comprises a plurality of temperature sensors for detecting change of heat transfer resistance of a selected heat transfer tube comprising a pair of spaced apart probes;

d) monitor means for comparing flow and discharge temperature signals from a selected first dual-tube device and for combining other flow and discharge temperature signals, from additional dual tube devices and connected to a microprocessor; and e) micro-processor means for utilizing inlet water temperature data provided by an inlet temperature sensor, continuously calculates, records and displays the individual heat transfer tube heat transfer co-efficient.

11. The combination sensing apparatus of claim 10 wherein the apparatus is adapted to monitor micro-biofouling of heat exchange between coolant and steam for condensing the steam in a condenser.

12. A method of monitoring fouling of the inner surfaces of heat transfer tubes of a heat exchanger including a method to accurately measure change in heat transfer of said heat exchanger as measured by change in heat transfer of actual individual heat transfer tubes within said heat exchanger while operational, comprising the steps of:

a) providing a probe assembly consisting of a dual tube and plug device attached to a discharge end of said heat exchanger without altering operating characteristics of said operating heat exchanger including:

i) providing temperature sensor devices;

ii) providing flow sensor devices; and iii) providing a calculator for generating a signal representing efficiency of said heat exchanger as reflected by change in conductivity of said heat transfer tubes as computed by the formula;

$$Q = U_T A(T_{STEAM} - T_{WATER})$$
$$Q = MC_P(T_{WATEROUT} - T_{WATERIN})$$

$$\therefore R_T \propto \frac{(T_{STEAM} - T_{WATERLOCALTEMP})}{\text{VELOCITYWATER}(T_{WATEROUT} - T_{WATERIN})}$$

b) detecting changes in heat transfer resistance of said heat transfer tubes; combining flow and discharge temperature signals from a first dual-tube device, with other flow and discharge temperature signals, from additional remotely spaced dual tube devices and comparing with clean conditions base line data; and d) transmitting flow and temperature signals to a micro-processor which, utilizing inlet water temperature data provided by an inlet temperature sensor, continuously calculates, records and displays the individual heat transfer tube heat transfer co-efficient.

13. The method of claim 12 wherein any number of probe assemblies are monitored within a heat exchanger shell, whereby electronic signals from each probe assembly are multi-plexed to an external micro-processor and wherein sensors achieve desired accuracy in directly measuring temperature and flow parameters in a heat exchanger or condenser while operating without interfering with the operation of said heat exchanger with a result that parameters to be tested are not altered by providing internal temperature and internal flow sensors and without altering operating characteristics of the heat exchanger being monitored wherein said on-line monitor continually monitors signals of temperature and flow sensors to provide a continuous reading of heat transfer co-efficient determining any deterioration in the performance of the heat exchanger.

* * * * *